United States Patent [19]

van de Vorle

[11] 4,286,041

[45] Aug. 25, 1981

[54] COMPOSITION AND PROCESS FOR DEVELOPING DIAZOTYPE MATERIAL

[75] Inventor: Wilhelmus J. M. van de Vorle, Venlo, Netherlands

[73] Assignee: Océ-van der Grinten, Venlo, Netherlands

[21] Appl. No.: 16,443

[22] Filed: Mar. 1, 1979

Related U.S. Application Data

[63] Continuation of Ser. No. 853,683, Dec. 8, 1977, abandoned.

[30] Foreign Application Priority Data

Dec. 10, 1976 [NL] Netherlands ..... 7631744

[51] Int. Cl.³ ..... G03C 1/58; G03C 5/22; G03C 5/34

[52] U.S. Cl. ..... 430/149; 430/154; 430/435; 430/486

[58] Field of Search ..... 430/149, 154, 435, 486

[56] References Cited

U.S. PATENT DOCUMENTS

| | | | |
|---|---|---|---|
| 2,113,944 | 4/1938 | Leuch | 430/149 |
| 4,043,816 | 8/1977 | Bomers | 430/149 |

FOREIGN PATENT DOCUMENTS

| | | |
|---|---|---|
| 272298 | 3/1964 | Australia . |
| 320603 | 4/1929 | United Kingdom . |
| 957836 | 5/1964 | United Kingdom . |
| 957837 | 5/1964 | United Kingdom . |
| 957838 | 5/1964 | United Kingdom . |
| 1417221 | 12/1975 | United Kingdom . |

OTHER PUBLICATIONS

West et al., Textbook of Biochemistry, 3rd Ed., pp. 34–41.

Lucas, Organic Chemistry, 2nd Ed., 1953, p. 196.

Lyman, American Pharmacy, 1945, pp. 128–129.

*Primary Examiner*—Edward C. Kimlin

*Attorney, Agent, or Firm*—Albert C. Johnston; Alphonse R. Noë

[57] ABSTRACT

A composition and process for developing diazotype material utilizes a developing liquid comprising a buffered, aqueous solution of an azo-coupling component having a pH between 5.5 and 8 and, as an additive compound, sorbic acid, an alkali metal salt, ammonium salt, or magnesium salt of sorbic acid or mixtures of the same. The process produces a clear copy image more quickly than a process in which the developing liquid does not contain the additive compound and, when the azo-coupling component is a mixture of phloroglucinol and resorcinol, forms a neutrally black image. The additive compound is added in an amount of 10 to 80%, and preferably 30 to 60%, by weight, of the maximum amount soluble in the solution at room temperature.

16 Claims, No Drawings

COMPOSITION AND PROCESS FOR DEVELOPING DIAZOTYPE MATERIAL

This is a continuation of copending application Ser. No. 853,683, filed Dec. 8, 1977 now abandoned.

This invention relates to the preparation of diazotype copies and, more particularly, to a composition and process for developing diazotype material using a buffered, aqueous solution of an azo-coupling component, having a pH between 5.5 and 8.

In the diazotype process, such as described in detail in Kosar, J., Light-sensitive systems, John Wiley & Sons, Inc., New York (1965), pp 194 ff., two different systems, the dry or ammonia process and the semi-wet process, are well known.

In the dry or ammonia process, a diazotype material is used in which a light-sensitive diazonium compound and an azo-coupling component are present in one layer. This layer also contains an acid stabilizer. After imagewise exposure, this material is developed by the action of moist ammonia gas, so that the diazonium compound left in the unexposed portions couples with the azo-coupling component to yield an azo-dyestuff. However, the resulting unpleasant and pungent odor of ammonia is a major disadvantage of this process. Therefore, to avoid excessive ammonia gas penetration into working areas, the copying apparatus used with this process must be fitted with an exhaust system. Nevertheless, the copies made retain the smell of ammonia for a long time.

In the semi-wet process, a diazotype material is used in which the light-sensitive layer comprises only the diazonium compound, with or without a stabilizer and other additives. Development occurs by spreading a thin layer of a buffered, aqueous solution of an azo-coupling component uniformly over the diazonium layer. In practice, the amount of azo-coupling component solution or developer applied is 7–8 $cm^3$ per square meter per side. This amount is necessary to ensure a uniform application of the developer as well as a fast and complete development with the usual developing devices and diazotype materials available. Generally, a nearly equal amount of developer is also applied to the reverse side of the copying material to prevent curling of the copy. A copy developed in this way contains a considerable amount of moisture. Although copies can be airdried when a few are made, if a large number of copies are to be made successively, a drying device is indispensable. Such a drying device requires a high heating capacity, particularly in a fast-working copying apparatus. Moreover, a considerable amount of time is required for the drying device to reach the desired drying temperature. This results in an undesired waiting period before the copying apparatus can be put into use. Therefore, attempts to find a developing process capable of producing dry or practically dry copies, but without the disadvantages of the ammonia process, have been made.

British Pat. No. 1,417,221 describes a process for making copies in which dry copies are obtained immediately and which does not have the drawbacks of the processes described above. According to that British patent, a diazotype material, comprising a support and a diazonium layer, is developed, after imagewise exposure, by uniformly spreading a pre-dosed quantity of 1.5–4.5 $cm^3$ per square meter of a neutral or weakly acidic, buffered, aqueous solution of an azo-coupling component over the diazonium layer. The copies made in this way are immediately dry to the touch and the small quantity of moisture applied evaporates in a rapid, spontaneous way, so that even fast working copying apparatus require no drying device.

The process described in the patent uses a developing liquid having a relatively low acidity in which the reaction between the diazonium salt and the azo-coupling component proceeds considerably slower than in a relatively strong alkaline medium. Nevertheless, a black image is built up readily due to the application of diazonium salts having a high coupling activity. Although only 15 seconds are generally required to produce a deeply black image, the process has a disadvantage in that the formation of the image starts slowly. Usually, about 7 to 8 seconds are required before a clear image formation can be observed. This is considered as a drawback, especially when apparatus with a high copying volume are used, because after every first copy is made one has to then wait more than 7 to 8 seconds to be able to judge whether the correct exposure time has been used. Furthermore, the shade of the black image obtained by that process is not quite satisfactory. Under the conditions present in the process, the most conventional azo-coupling components, phloroglucinol and resorcinol, generally produce a violetish-black and a brownish-black image, respectively. When mixtures of these two azo-coupling components are used, the violetish and brownish shade will partially compensate one another; but because both shades contain a red component, this component remains and the resulting black image has a reddish shade.

A developing process and liquid composition reducing those disadvantages considerably has now been found. The developing liquid according to this invention comprises a buffered, aqueous solution of an azo-coupling component having a pH between 5.5 and 8, of the type referred to previously, containing sorbic acid and/or an alkali metal salt, ammonium salt or magnesium salt of sorbic acid.

Surprisingly, it has been found that the formation of the copy image is obtained more quickly, if the developing liquid contains sorbic acid or one of the sorbic acid salts mentioned. Moreover, the shade of the black image shifts from reddish towards neutral. In the presence of sorbic acid the violetishblack developing phloroglucinol produces a more acceptable bluishblack, while with resorcinol a black image containing a decreased brown hue is formed. As a result of this effect, a mixture of phloroglucinol and resorcinol in the presence of sorbic acid forms a neutrally black image.

The maximum amount of sorbic acid to be used is determined by its solubility in the developing liquid at room temperature. At a pH of 8, a maximum amount of approximately 260 g per liter can be added; at a pH of 6.5 this maximum amount is approximately 52 g per liter; and at a pH of 5.5, it is 16 g per liter. To prevent sorbic acid from crystallizing out as a result of temperature fluctuations, generally not more than 80% by weight of the maximum soluble amount is added. For an optimum result, a quantity of 30–60% by weight of the maximum soluble amount is sufficient. For example, when an aqueous, buffered solution having a pH of 6.5 is used, the amount of sorbic acid is 15 to 30 g per liter of developing liquid. The minimum quantity is not critical. An amount as low as 10% of the maximum soluble amount results in a favorable effect.

The addition of sorbic acid is useful only if the developing liquids have a pH of about 5.5–8. Such developers are described, for example, in the British Pat. No. 1,417,221, referred to above, in British Pat. No. 957,836 and in French Pat. No. 1,347,703. The desirable image formation effect of the sorbic acid is highest with the concentrated developing liquids disclosed in British Pat. No. 1,417,221, in which the amount of the azo-coupling component is between 0.1 and 0.6 g. mol per liter and the amount of buffer acid is between 0.5 and 3 gram-equivalents per liter. Under those conditions, the buffer acid is partially present as a salt, generally in the form of an alkali metal salt, ammonium salt or magnesium salt. Since the sorbic acid also has a buffer capacity, it is desirable to compensate the total amount of buffer acid for the amount of sorbic acid added. Of course, buffers other than those referred to in British Pat. No. 1,417,221 can also be used, provided they produce the desired pH and possess sufficient buffer capacity. Very suitable buffers are alkali metal, ammonium and/or magnesium salts of succinic, glutaric, adipic, β-methyl-adipic, maleic, malonic and citric acid, which can be used separately or mixed.

In addition to phloroglucinol or instead of phloroglucinol, which is generally used as the azo-coupling component, other azo-coupling components, such as resorcinol, may be used. Preferably, a mixture of resorcinol and phloroglucinol is used, because this combination produces a precise, deeply black shade on diazotype material in the presence of sorbic acid.

Furthermore, the developing liquid composition according to this invention may contain the conventional antiyellowing agents, antioxydants, dispersing agents and wetting agents.

The developing liquid having the composition according to this invention can be used on diazotype materials containing a light-sensitive layer with fast coupling diazonium salts. Preferably, these developers are used for the development of diazotype materials containing one or more diazonium salts of which the in vitro coupling activity is higher than that of p-diazo-o-chloro-diethylaniline. The definition of coupling activity is set forth in British Pat. No. 957,836 which also sets forth, as does British Pat. No. 957,838, examples of such fast coupling diazonium salts. Suitable salts are water-soluble salts, such as the hydrogen sulphate or the chloride of the following compounds:

1-diazo-4-benzoylamino-2,5-dibutoxy-benzene
1-diazo-2,5-dimethoxy-4-(4'-methyl) phenylthio-benzene
1-diazo-2,5-diethoxy-4-(4'-methyl)phenylthio-benzene
1-diazo-4-dimethylamino-3-(4'-chloro)phenoxy-6-chloro-benzene
1-diazo-4-dimethylamino-3-(4'-chloro)phenoxy-2-chloro-benzene
1-diazo-2-(ethoxycarbonyl)(benzyl)amino-4-(methyl)-(cyclohexyl) amino-3-methoxy-benzene
1-diazo-4-benzoylamino-2-(ethoxycarbonyl)(methyl-)amino-5-methoxy-benzene
1-diazo-2-(ethoxycarbonyl)(methyl)amino-5-methoxy-4-(4'-methyl) phenylthio-benzene.

Moreover, the usual auxiliary agents, such as acids and stabilizers, e.g. the sodium salt of 1,3,6-naphthalene trisulphonic acid, reducing agents, thiourea, and the like, may be present.

The more concentrated developing liquids of the preferred developing liquid compositions according to this invention are especially suitable for the development of diazotype materials containing the diazonium salts in a thin layer with an average thickness of at most 8 μm. Such materials, which are described, for example, in British Pat. No. 1,417,221, can be developed by applying, to one side, 1.5–4.5 $cm^3$ per square meter of the concentrated developing liquid. The concentrated developing liquid is also highly suitable for the development of th diazotype materials of the type described in German patent application Nos. 2,522,173 and 2,540,393, which contain, in the light-sensitive layer, a diazonium salt, filler particles including starch, and a binder such as polyvinyl alcohol.

EXAMPLE

A base paper for the diazotype process having a weight of 65 $g/m^2$ was coated, on either side, with a barrier layer having a dry weight of 5 $g/m^2$, by a liquid having the following composition:

400 ml of a 50 percent aqueous dispersion of a copolymer of 70% by weight of styrene and 30% by weight of butadiene, 100 g of amorphous silica having a primary particle size of approximately 30 nanometers, and 600 ml of water.

One side of the paper was then provided with a light-sensitive layer having a dry weight of about 7 $g/m^2$ and an average thickness of 7 μm by a liquid having the following composition:

10 g of 4-dimethylamino-3-(4'-chlorophenoxy)-6-chlorobenzene-diazonium-hydrogensulphate,
2.5 g of 2.5-diethoxy-4-(4'-methyl)phenylthio-benzenediazonium-hydrogensulfate,
5 g of polyvinyl alcohol with a degree of hydrolysis over 98% (available as Gohsenol NH26 from Nippon Gohsei, Osaka, Japan),
5 g of hexamethoxymethymelamine, 300 g of rice starch, and
water to make up 1 liter.

The light-sensitive layer was dried by heating the paper at 60°–70° C. until the moisture content of the paper amounted to approximately 4% by weight. The diazotype material obtained was exposed underneath a transparent line original until the diazonium compound under the white portions of the original had been bleached out completely.

The exposed material was developed with a developing liquid having the following composition:

50 ml of ethylene glycol,
20 g of sorbic acid,
70 g of succinic acid,
100 ml of a 50% by weight solution of KOH
14 g of phloroglucinol,
10 g of resorcinol,
10 g of thiourea,
0.7 g of wetting agent (available as Tergitol anionic 4 from Union Carbide Corp., U.S.A.), and water to make up 1 liter.

The pH of the solution was 6.5.

3.5 $cm^3$ of this liquid was applied per square meter of the exposed diazotype material using a developing device of the type described in German patent application No. 2,528,855. A clear black image, making it possible to judge the exposure time chosen, was formed within 5 seconds. During the subsequent 10 seconds, the optical density increased only to a relatively small extent. The color of the image was neutrally black. Upon development of the same diazotype material with a developer as described above, but in which the sorbic acid had been replaced by an equivalent amount of succinic acid, scarcely any optical density of the image was visible during the first 7 seconds, while after completion of the development the image obtained had a black color with a reddish hue.

I claim:

1. In a composition for developing diazotype material, comprising an aqueous solution of an azo-coupling component comprising phloroglucinol and a buffering agent in an amount sufficient to give said solution a pH between 5.5 and 8, the improvement comprising that said solution also contains, in addition to said buffering agent, a sorbic compound selected from the group consisting of sorbic acid, alkali metal, ammonium, and magnesium salts of sorbic acid and mixtures of the same, said sorbic compound being present in an amount sufficient to shift toward neutrally black the hue of the dyestuff formed by reaction of said solution with a diazonium salt of which the in vitro coupling activity is higher than that of p-diazo-o-chloro-diethylaniline.

2. A developing composition according to claim 1 wherein the amount of said sorbic compound is 10 to 80% by weight of the maximum amount thereof that is soluble in said solution at room temperature.

3. A developing composition as claimed in claim 1 wherein the amount of said sorbic compound is 30 to 60% by weight of the maximum amount thereof that is soluble in said solution at room temperature.

4. A developing composition as claimed in claim 1, said buffering agent consisting at least partially of one or more compounds selected from the group consisting of alkali metal, ammonium and magnesium salts of buffer acid other than sorbic acid and the total amount of buffer acid, calculated by including the buffering capacity of said agent and any buffering capacity of said sorbic compound, being in the range from 0.5 to 3 gram-equivalents per liter of said solution.

5. A developing composition as claimed in claim 4, said buffering agent consisting essentially of one or more buffer acids selected from the group consisting of succinic, glutaric, adipic, β-methyl-adipic, maleic, malonic and citric acids and one or more of the alkali metal, ammonium and magnesium salts of said acids.

6. A developing composition as claimed in claim 1 wherein said azo-coupling component is present in an amount of 0.1 and 0.6 gram-molecules per liter of said solution.

7. A developing composition as claimed in claim 1 wherein said azo-coupling component consists essentially of a mixture of phloroglucinol and resorcinol.

8. A diazotype material developing composition comprising an aqueous solution of 0.1 to 0.6 g. mol/1 of an azo-coupling component selected from the group consisting of phloroglucinol, resorcinol and mixtures of the same, a buffering agent in an amount sufficient to give said solution a pH between 5.5 and 8, and a sorbic compound selected from the group consisting of sorbic acid, alkali metal, ammonium and magnesium salts of sorbic acid and mixtures of the same, said sorbic compound being present in an amount sufficient to shift toward neutrally black the hue of the dyestuff formed by reaction of said solution with a diazonium salt of which the in vitro coupling activity is higher than that of p-diazo-o-chloro-diethylaniline, said amount being equivalent to 30 to 60% by weight of the maximum amount of said sorbic compound that is soluble in said solution at room temperature, said solution having a buffer acid content of 0.5 to 3 gram-equivalents per liter, calculated by including the buffering capacity of said agent and any buffering capacity of said sorbic compound.

9. A process for preparing a diazotype copy, comprising imagewise exposing to light a diazotype material the lightsensitive layer of which has an average thickness not exceeding 8 microns and comprises a diazonium compound of which the in vitro coupling activity is higher than that of p-diazo-o-chlorodiethylaniline, and developing the exposed material by applying to said layer 1.5 to 4.5 $cm^3$, per square meter of exposed material, of an aqueous solution of an azo-coupling component comprising phloroglucinol and a buffering agent in an amount sufficient to give said solution a pH between 5.5 and 8, said solution containing in addition to said buffering agent a sorbic compound in an amount sufficient to shift toward neutrally black the hue of the dyestuff formed by reaction of said solution with said diazonium compound, said sorbic compound being selected from the group consisting of sorbic acid, alkali metal, ammonium, and magnesium salts or sorbic acid and mixtures of the same.

10. A process as claimed in claim 9 wherein the amount of said sorbic compound is 10 to 80% by weight of the maximum amount thereof that is soluble in said solution at room temperature.

11. A process as claimed in claim 9 wherein the amount of said sorbic compound is 30 to 60% by weight of the amount thereof that is soluble in said solution at room temperature.

12. A process as claimed in claim 9 wherein said solution contains 0.5 to 3 gram equivalent of buffer acid per liter of said solution, calculated by including the buffering capacity of said agent and any buffering capacity of said sorbic compound, said buffering agent consisting at least partially of one or more compounds selected from the group consisting of alkali metal, ammonium, and magnesium salts of buffer acid other than sorbic acid.

13. A process as claimed in claim 12, said buffering agent consisting essentially of one or more buffer acids selected from the group consisting of succinic, glutaric, adipic, β-methyladipic, maleic, amlonic and citric acids and one or more of the alkali metl, ammonium and magnesium salts of said acids.

14. A process as claimed in claim 9 wherein said azo-coupling component is present in an amount of 0.1 to 0.6 grammolecules per liter of said solution.

15. A process as claimed in claim 9 wherein said azo-coupling component consists essentially of a mixture of phloroglucinol and resorcinol.

16. A diazotype copy having image areas thereof formed by a substantially neutrally black dyestuff, produced by a process according to claim 9.

* * * * *